US010670368B1

(12) United States Patent
Liu

(10) Patent No.: US 10,670,368 B1
(45) Date of Patent: Jun. 2, 2020

(54) COCKING DEVICE FOR A CROSSBOW

(71) Applicant: Chi-Chang Liu, Taichung (TW)

(72) Inventor: Chi-Chang Liu, Taichung (TW)

( * ) Notice: Subject to any disclaimer, the term of this patent is extended or adjusted under 35 U.S.C. 154(b) by 0 days.

(21) Appl. No.: 16/558,166

(22) Filed: Sep. 2, 2019

(51) Int. Cl.
*F41B 5/12* (2006.01)

(52) U.S. Cl.
CPC ..... *F41B 5/123* (2013.01); *F41B 5/12* (2013.01)

(58) Field of Classification Search
CPC ..... F41B 5/12; F41B 5/123
See application file for complete search history.

(56) References Cited

U.S. PATENT DOCUMENTS 3,028,851 A * 4/1962 Drake ..... F41B 5/12 124/16
3,670,711 A * 6/1972 Firestone ..... F41B 5/12 124/25
3,783,852 A * 1/1974 Shepherd ..... F41B 5/12 124/22
4,649,892 A * 3/1987 Bozek ..... F41B 5/10 124/25
4,719,897 A * 1/1988 Gaudreau ..... F41B 5/1469 124/25
4,827,894 A * 5/1989 Schallberger ..... F41B 5/12 124/25
4,942,861 A * 7/1990 Bozek ..... F41B 5/12 124/25
5,215,069 A * 6/1993 Liu ..... F41B 5/12 124/25
7,204,242 B2 * 4/2007 Dziekan ..... F41B 5/12 124/25
10,378,853 B1 * 8/2019 Liu ..... F41B 5/1469

* cited by examiner

*Primary Examiner* — John A Ricci

(57) ABSTRACT

A cocking device for a crossbow includes a cocking unit which is pivotably connected to the body of the crossbow, and has a cocking unit which is detachably engaged with a holding unit connected to the grip of the crossbow by the locking unit. The cocking unit includes an opening located next to the locking unit. A scrolling unit is accommodated in the cocking unit and includes a scrolling member, an axle, a ratchet disk and a stop. The scrolling member driving the axle which drives the ratchet disk. The stop is located corresponding to the opening. The stop has the first end thereof normally engaged with one of ratchets of the ratchet disk. The second end of the stop extends through the opening. The stop is pivotable to engage with the ratchet disk or to release the ratchet disk to control the operation of the scrolling member.

6 Claims, 9 Drawing Sheets

COCKING DEVICE FOR A CROSSBOW

BACKGROUND OF THE INVENTION

1. Fields of the Invention

The present invention relates to a cocking device for a crossbow and the cocking device can easily draw the string of the crossbow and can be held during operation.

2. Descriptions of Related Art

The conventional cocking action to a crossbow is to secure the cocking stirrup on the ground, and then to draw the string toward the stock by both hands. The string is difficult to be drawn for some users, especially for compound crossbows which can generate a lot of force to the arrows. The users have to overcome the recovery force of the string to cock the string. In some cases, if the users cannot hold the string on the way of drawing the string back and the string is released, the string can injure the users. Although there are many types of accessories for helping the users to draw the string, a certain level of muscle force is required. For some users, a cocking device that is safe and easily operated is needed.

The present invention intends to provide a cocking device for a crossbow which eliminates the shortcomings mentioned above.

SUMMARY OF THE INVENTION

The present invention relates to a cocking device for a crossbow and comprises a body and a grip, and a trigger unit is connected to the body. The cocking device comprises a cocking unit, locking unit and a scrolling unit. The cocking unit includes the first end thereof pivotably connected to the body, and the second end of the cocking unit has the locking unit connected thereto. The second end of the cocking unit is detachably engaged with a holding unit connected to the grip by the locking unit. The cocking unit includes an opening located next to the locking unit. The scrolling unit is accommodated in the second end of the cocking unit and includes a scrolling member, an axle, a ratchet disk and a stop. The axle is pivotably connected in the cocking unit. The first end of the scrolling member is connected to the axle, and the second end of the scrolling member is connected to a holding unit in the grip. The ratchet disk is fixed to the axle and located at a distance from the scrolling member. The scrolling member drives the axle which drives the ratchet disk. The stop is pivotably connected to the cocking unit and located corresponding to the opening. The stop has the first end thereof normally engaged with one of ratchets of the ratchet disk, and the second end of the stop extends through the opening. The stop is pivotable to engage with the ratchet disk or to release the ratchet disk. The scrolling member is extended when the second end of the cocking unit is pivoted away from the grip. When the stop is engaged with the ratchet disk, the scrolling member is held.

The primary object of the present invention is to provide a cocking device for a crossbow and the users simply pivots the cocking unit to draw the string of the crossbow. The users are able to take a rest by engaging the stop with the ratchet disk of the scrolling unit during pivoting the cocking unit.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
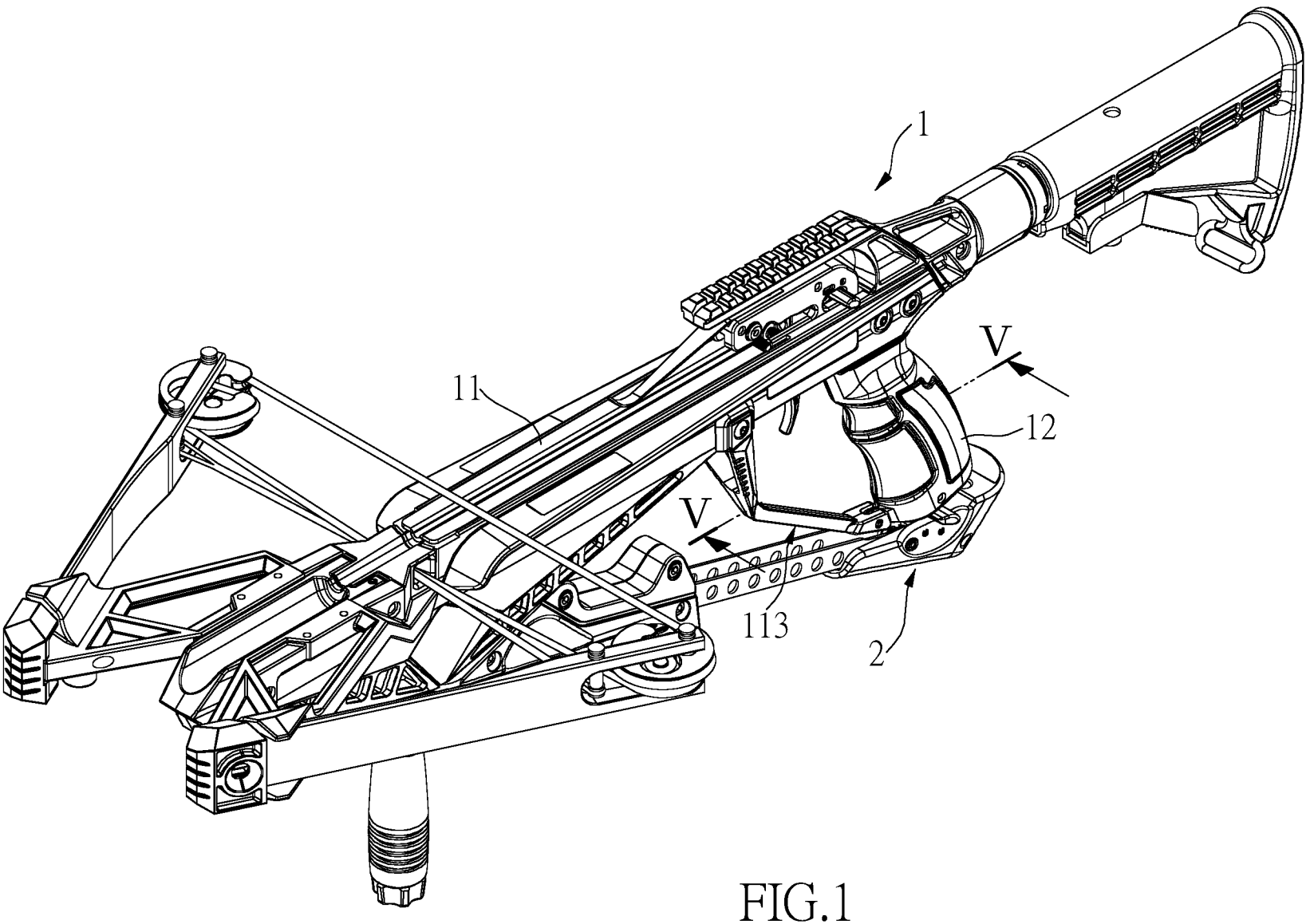
FIG. 1 is a perspective view to show a crossbow with the cocking unit of the present invention.
Figure 2:
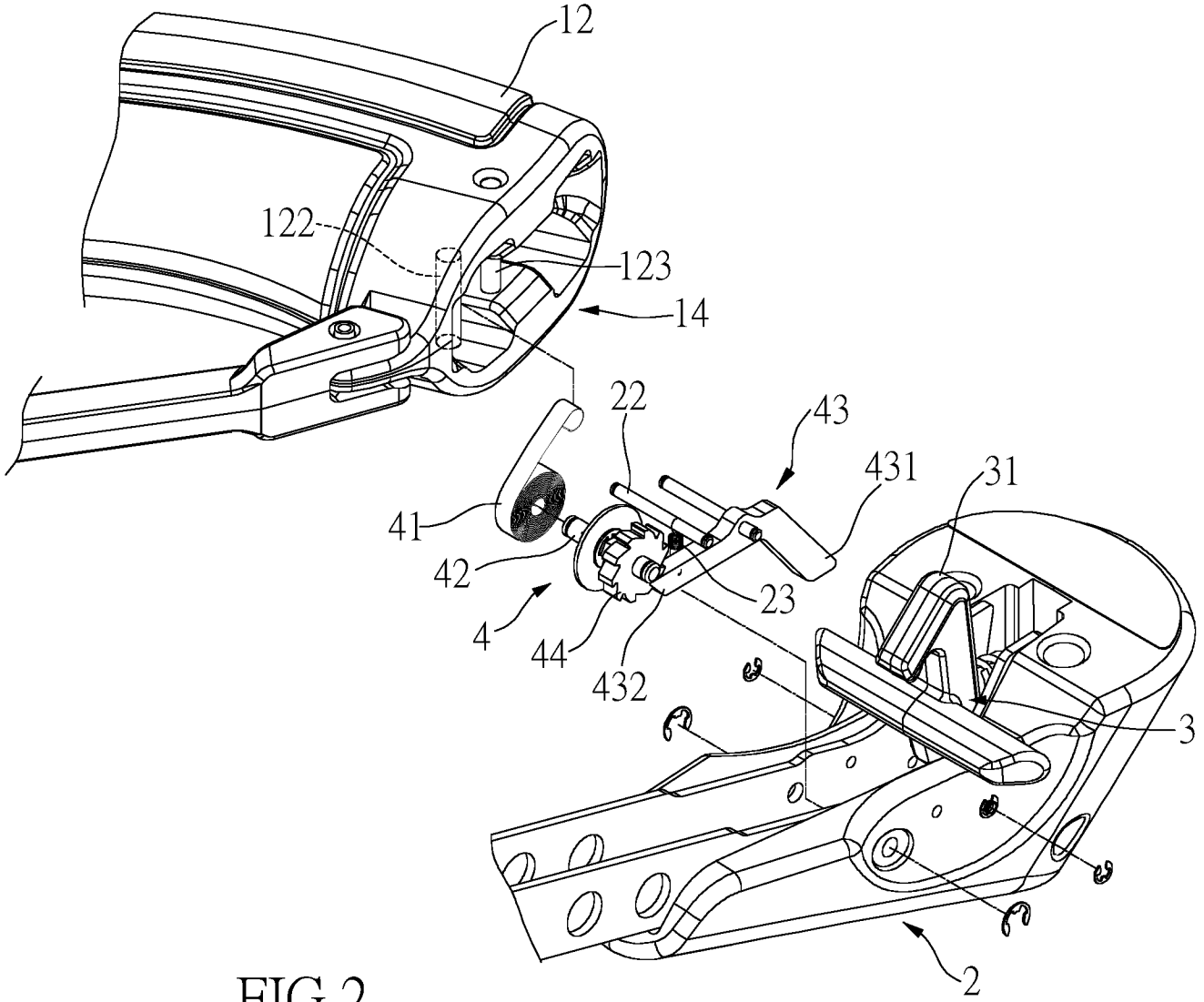
FIG. 2 is an exploded view of the cocking unit of the present invention.
Figure 3:
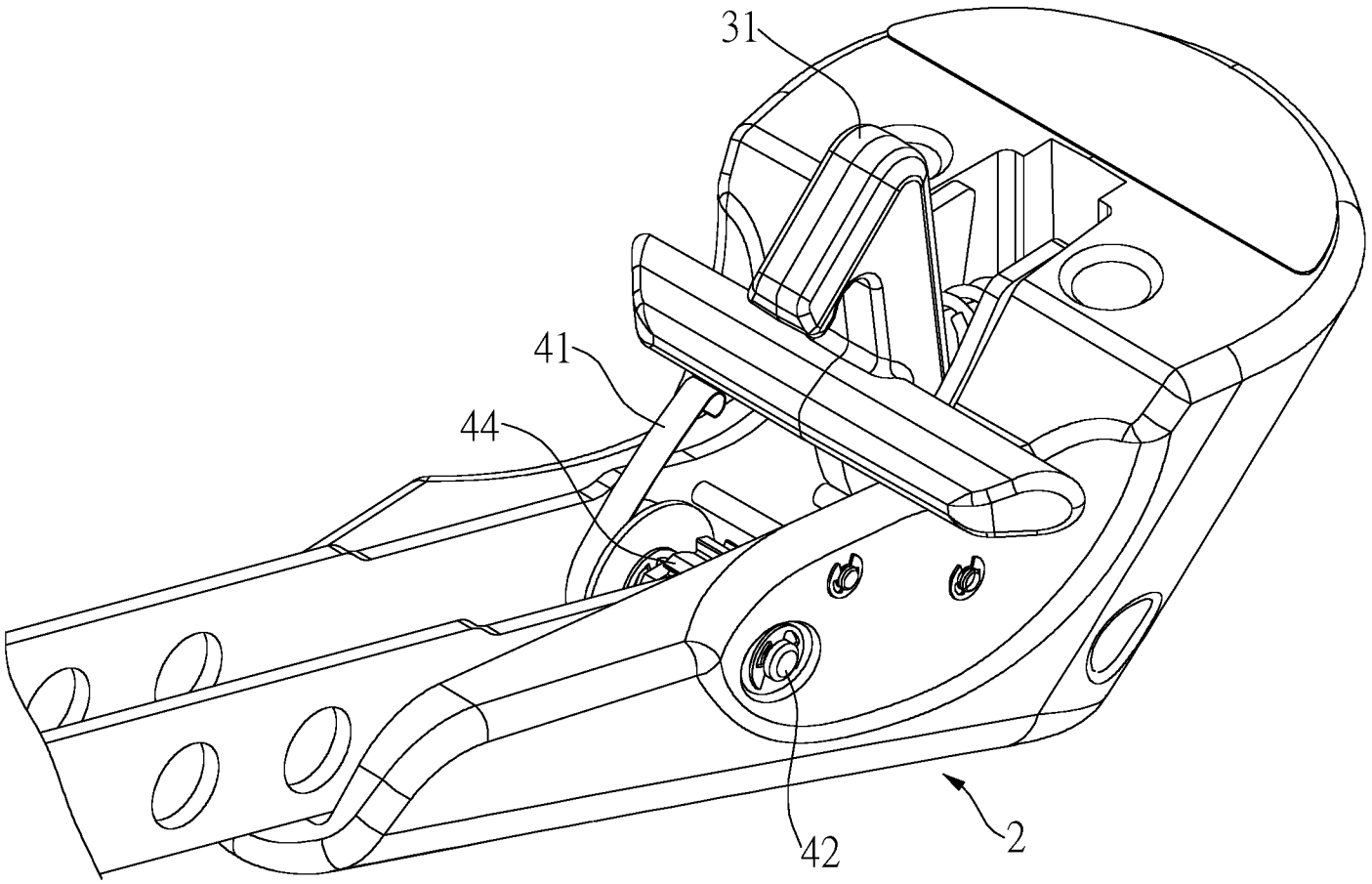
FIG. 3 shows a portion of the cocking unit of the present invention.
Figure 4:
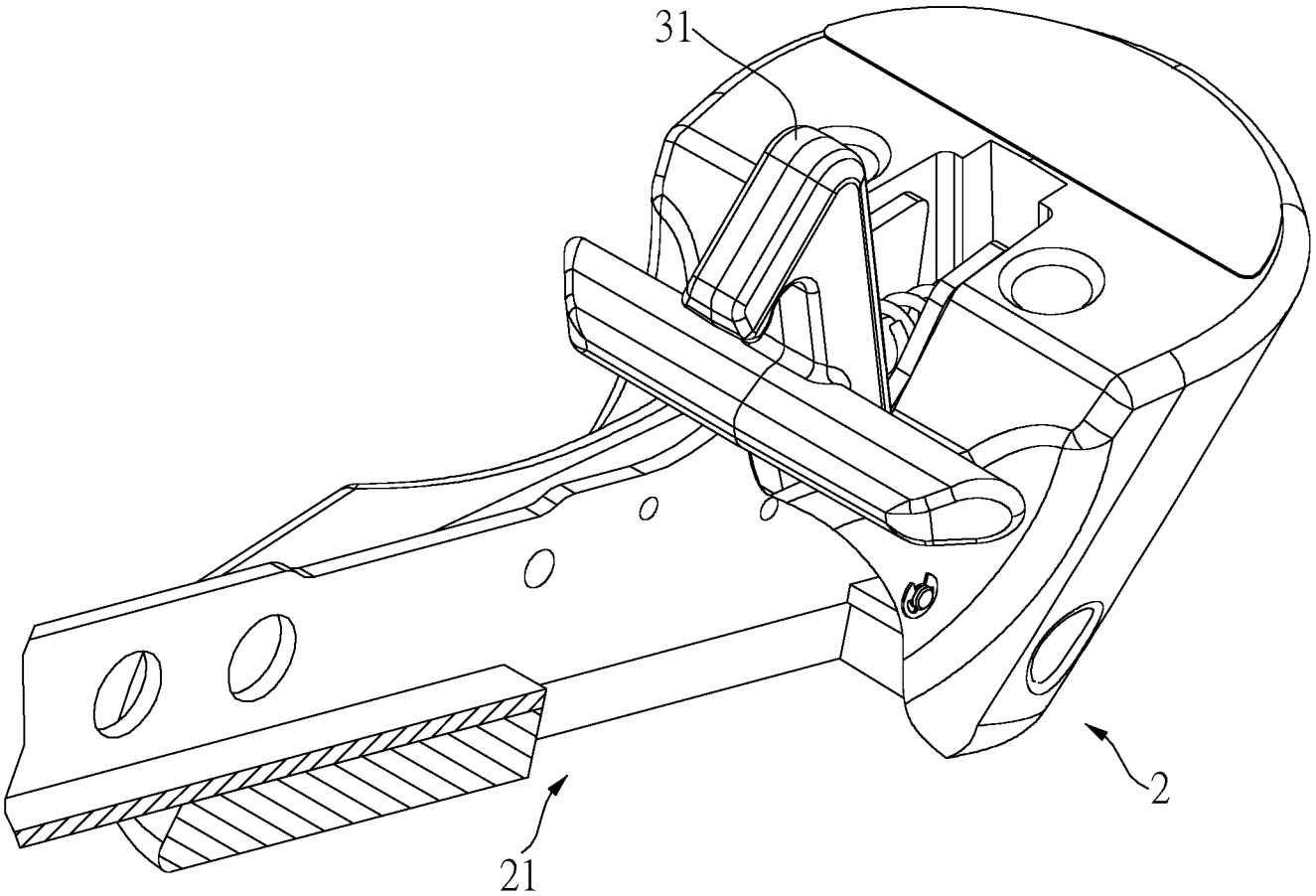
FIG. 4 shows that the opening of the cocking unit of the present invention.

Referring to FIGS. 1 to 8, the cocking device of the present invention is installed to a crossbow 1 which includes a body 11 and a stock. A grip 12 extends from the underside of the body 11 and located close to the stock. A trigger unit 113 is connected to the body 11 and the grip 12. A crossbow is connected to the top of the front end of the body 11. The cocking device of the present invention comprises a cocking unit 2 which generally is a link or a lever, and has the first end thereof pivotably connected to the front end of the body 11, and the second end of the cocking unit 2 has a locking unit 3 connected thereto. The second end of the cocking unit 2 is detachably engaged with a holding unit 14 connected to the grip 12 by the locking unit 3. The cocking unit 2 includes an opening 21 formed in the underside of the cocking unit 2 and located next to the locking unit 3 as shown in FIG. 4.

A scrolling unit 4 is accommodated in the second end of the cocking unit 2 and includes a scrolling member 41, an axle 42, a ratchet disk 44 and a stop 43. The axle 42 is pivotably connected in the cocking unit 2. The first end of the scrolling member 41 is connected to the axle 42, and the second end of the scrolling member 41 extends beyond the second end of the grip 12 and is connected to a holding unit 14. In this embodiment, the holding unit 14 is located at the bottom opening of the grip 12 but is not restricted thereto. The ratchet disk 44 is fixed to the axle 42 and located at a distance in parallel from the scrolling member 41. When the scrolling member 41 is driven, the axle 42 is co-rotated which drives the ratchet disk 44. The stop 43 is pivotably connected to the cocking unit 2 and located corresponding to the opening 21. The stop 43 has the first end thereof normally engaged with one of ratchets of the ratchet disk 44, and the second end of the stop 43 extends through the opening 21. The pivotal action of the stop 43 controls the rotation of the ratchet disk 44 which indirectly controls the scrolling action of the scrolling member 41. When the cocking unit 2 is pivoted away from the grip 12 so that the stop 43 is pivoted to be disengaged from the ratchet disk 44, the scrolling member 41 extends so as to form a controllable status. On the contrary, when the stop 43 is pivoted to be engaged with the ratchet disk 44, the ratchet disk 44 stops to rotate, and the scrolling member 41 stops to extend so as to form a hold status.

As shown in FIGS. 4 to 9, when the user wants to draw the string, the user pivots the cocking unit 2 toward the front end of the body 11 to allow the catching member (not shown) to catch the string. When the cocking unit 2 is pivoted to return, the string is drawn toward the grip 12. An arrow is then put in the guide groove (not shown) of the body 11. It is noted that the pivotal action of the cocking unit 2 extends the scrolling member 41, and the scrolling member 41 is co-rotated with the ratchet disk 44 by the axle 42, so that stop 43 moves over the ratchets of the ratchet disk 44. Therefore, the string can be quickly drawn.

When the user wants to pivot the cocking unit 2 to be engaged with the grip 12, the user operates the stop 43 to disengage the stop 43 from the ratchet disk 44, so that the recovery force of the scrolling member 41 helps the user to return the cocking unit 2 to the grip 12 to form the hold status. These steps save the user's effort.

Figure 9:
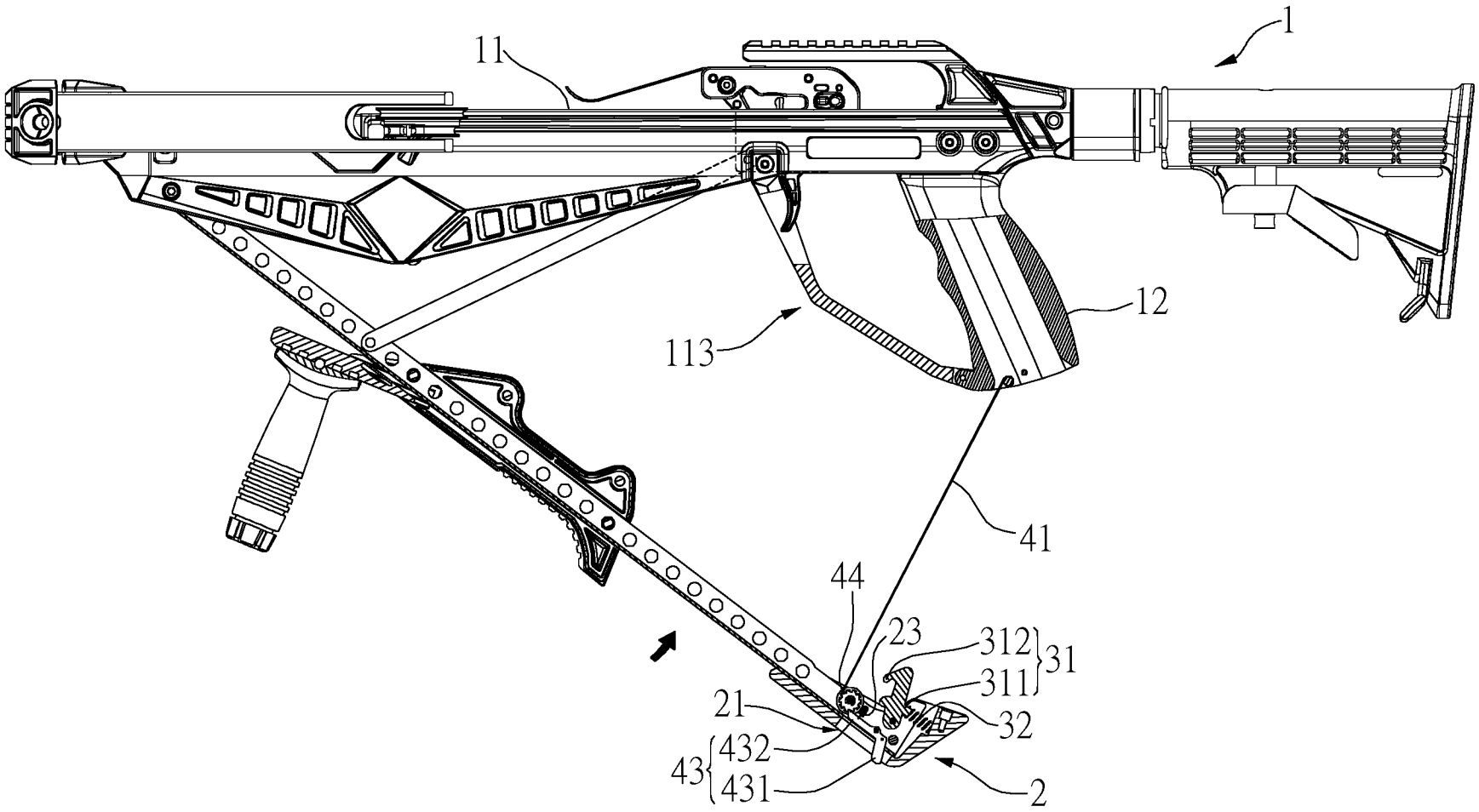
FIG. 9 shows that the cocking unit is pivoted toward the grip, and the stop is engaged with the ratchet disk to restrict the cocking unit to be pivoted.

The stop 43 allows the user to stop the drawing action during operation. As shown in FIGS. 2 and 9, the stop 43 includes a lever 431 and an engaging portion 432, wherein the engaging portion 432 extends laterally from one end of the lever 431 and located in the cocking unit 2, and the lever 431 partially extends through the opening 21 and located beyond the cocking unit 2. The user can easily access the lever 431 to control the pivotal action of the stop 43 to allow the stop 43 to engage with or disengage from the ratchet disk 44. The user can take a rest by engaging the engaging portion 432 with the ratchet disk 44 to restrict the extension of the scrolling member 41 so that the cocking unit 2 is held and waits for next pivoting action.

Figure 5:
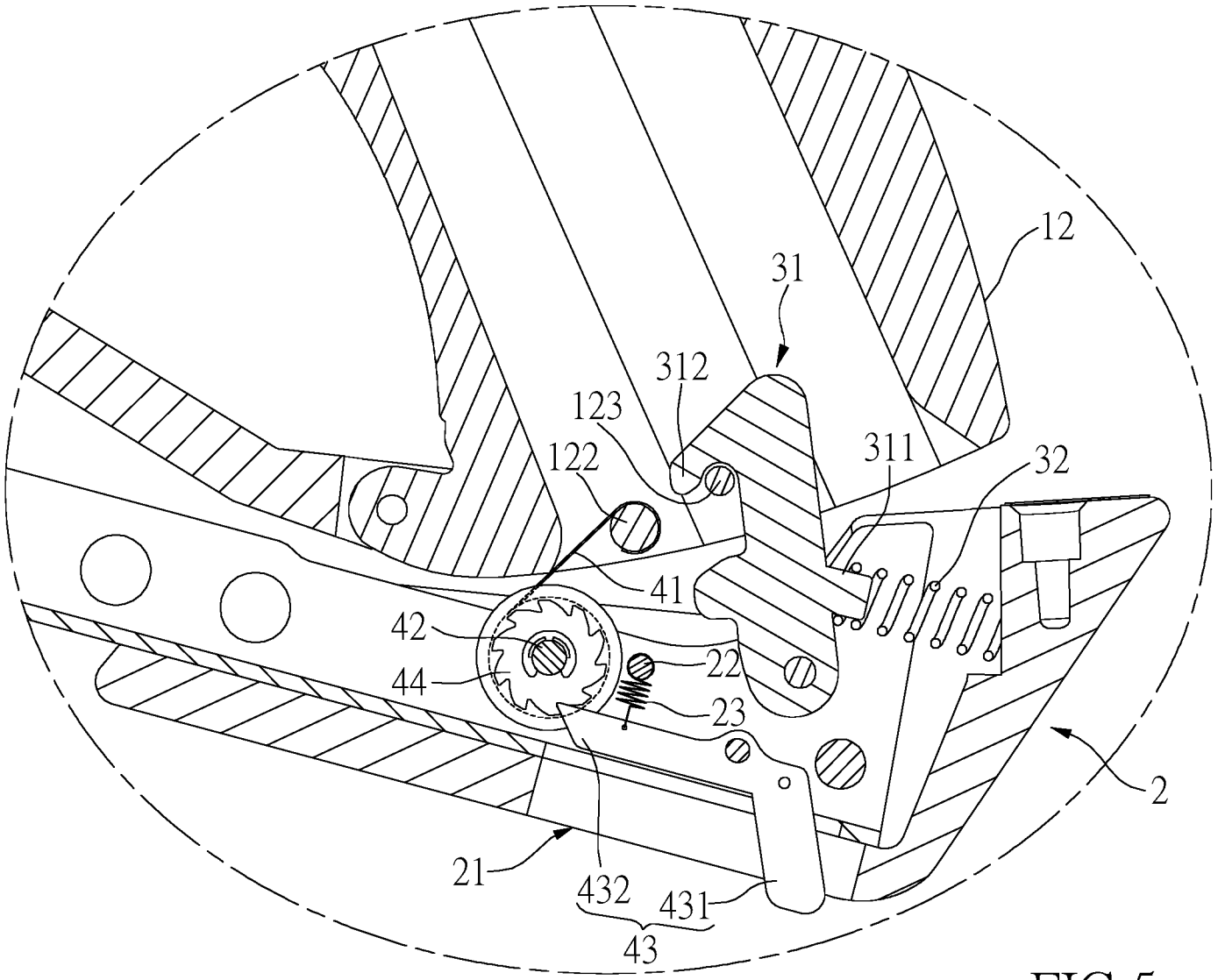
FIG. 5 is a cross sectional view, taken along line V-v in FIG. 2.
Figure 6:
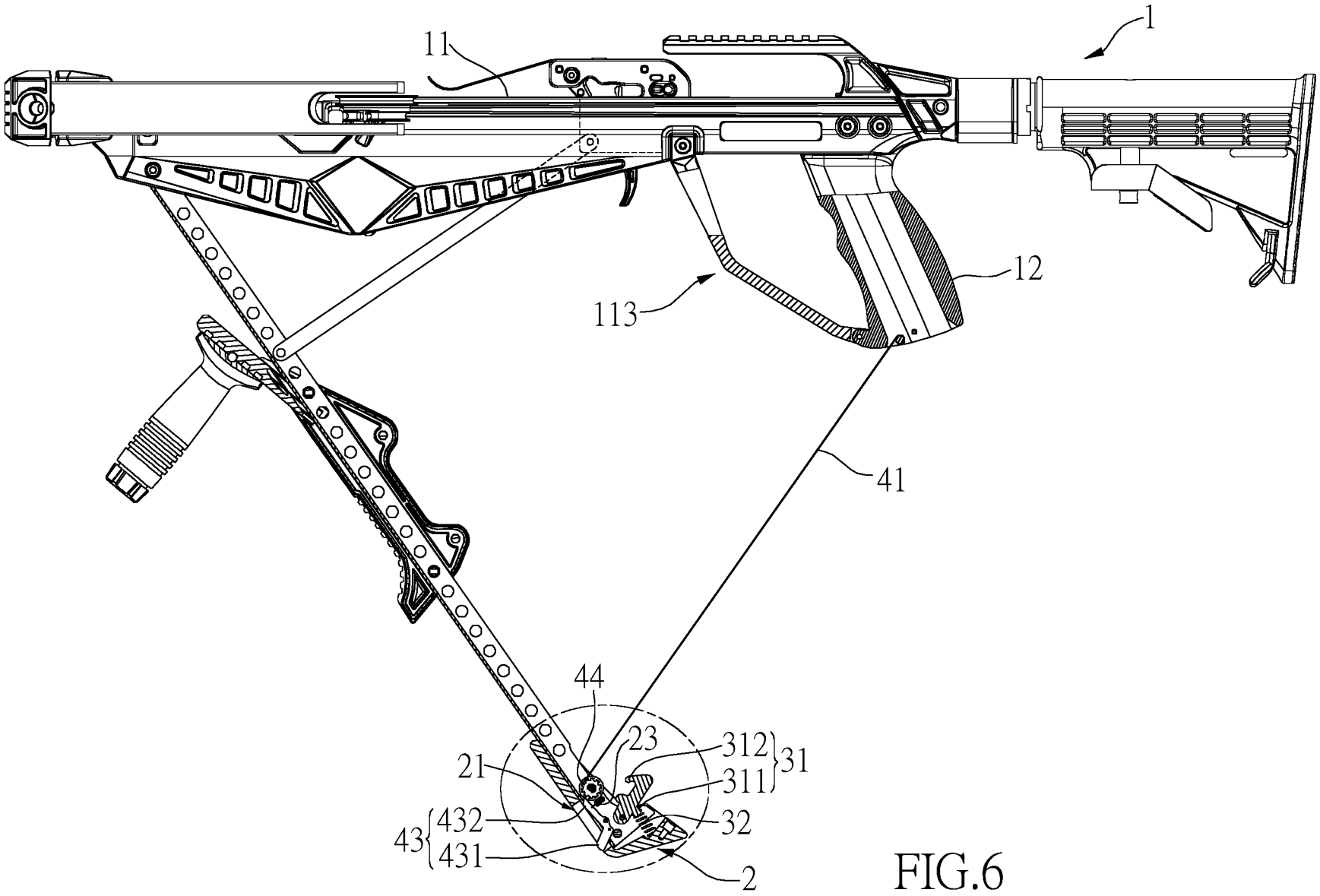
FIG. 6 shows that the cocking unit is pivoted away from the grip, and the cross sectional view showing the cocking unit.
Figure 7:
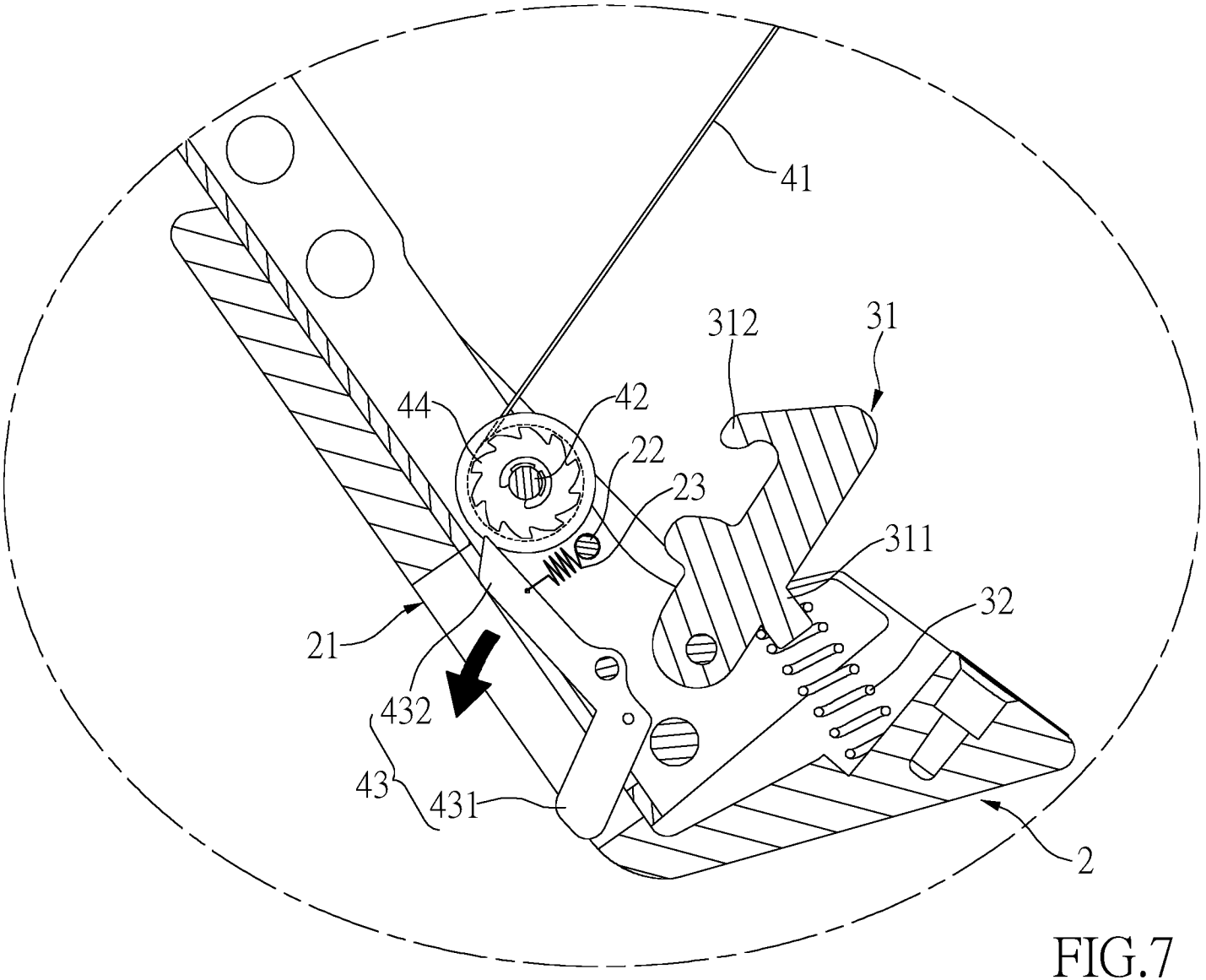
FIG. 7 is a cross sectional view to show that the stop is disengaged from the ratchet disk.
Figure 8:
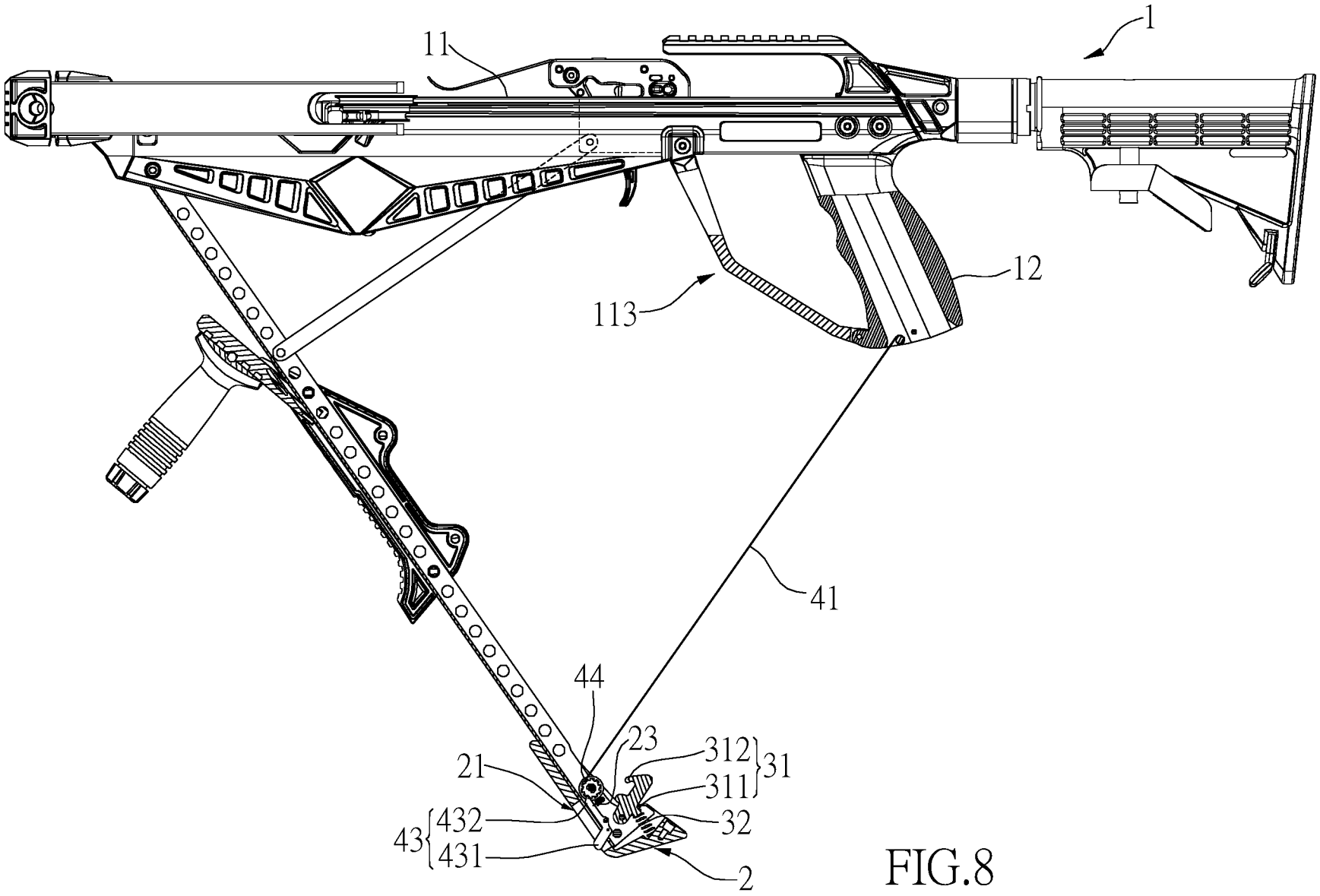
FIG. 8 shows that the cocking unit is pivoted away from the grip, and the stop is brought to be engaged with the ratchet disk by the resilient member.

Specifically, the cocking unit 2 includes a pin 22 and a resilient member 23, wherein the resilient member 23 has the first end mounted to the pin 22, and the second end of the resilient member 23 is connected to the second end or engaging portion 432 of the stop 43. When the lever 431 is operated to pivot the stop 43 to be disengaged from the ratchet disk 44, the stop 43 pulls the resilient member 23 to store a recovery force. When the user releases the stop 43, the holding force to the lever 431 of the stop 43 is disappeared, the recovery force of the resilient member 23 pivots the stop 43 to engage with the ratchet disk 44. As shown in FIG. 7, the grip 12 includes the bottom opening and a column 122 is located in the bottom opening of the grip 12, and the second end of the scrolling member 41 is connected to the column 122. The cocking unit 2 is pivoted to pull the scrolling member 41 as shown in FIGS. 2 and 5.

When the user wants to return the cocking unit 2, in order to prevent the cocking unit 2 from being separated from the grip 12, the locking unit 3 includes a hooking member 31 and a spring 32. The hooking member 31 has the first end thereof pivotably connected to the cocking unit 2. A hook end 312 is formed on the second end of the hooking member 31. The spring 32 has the first end thereof biasing the cocking unit 2, and the second end of the spring 32 is mounted to a protrusion 311 of the hooking member 31. The hooking end 312 hooks to a rod 123 located in the grip 12 when the hooking member 31 is pivoted to be engaged with the grip 12 as shown in FIGS. 2 and 3.

The present invention let the users to easily return the cocking unit 2 by the help of the recovery force of the scrolling member 41. The engagement between the engaging portion 432 of the stop 43 and the ratchet disk 44 allows the users to hold the cocking unit 2, and this feature is helpful for some users who do not have sufficient muscle force.

While we have shown and described the embodiment in accordance with the present invention, it should be clear to those skilled in the art that further embodiments may be made without departing from the scope of the present invention.

What is claimed is:

1. A cocking device for a crossbow which includes a body and a grip, a trigger unit connected to the body, the cocking device comprising:

a cocking unit having a first end thereof adapted to be pivotably connected to the body, a second end of the cocking unit having a locking unit connected thereto, the second end of the cocking unit detachably engaged with a holding unit adapted to be connected to the grip by the locking unit, the cocking unit including an opening located next to the locking unit, and a scrolling unit accommodated in the second end of the cocking unit and including a scrolling member, an axle, a ratchet disk and a stop, the axle pivotably connected in the cocking unit, a first end of the scrolling member connected to the axle and a second end of the scrolling member connected to a holding unit, the ratchet disk is fixed to the axle and located at a distance from the scrolling member, the scrolling member driving the axle which drives the ratchet disk, the stop pivotably connected to the cocking unit and located corresponding to the opening, the stop having a first end thereof normally engaged with one of ratchets of the ratchet disk, a second end of the stop extending through the opening, the stop being pivotable to engage with the ratchet disk or to release the ratchet disk, the scrolling member being extended when the second end of the cocking unit is adapted to be pivoted away from the grip, when the stop is engaged with the ratchet disk, the scrolling member is held.

2. The cocking device as claimed in claim 1, wherein the stop includes a lever and an engaging portion, engaging portion extends laterally from one end of the lever and located in the cocking unit, the lever partially extends through the opening and located beyond the cocking unit, the stop is pivoted within the opening so as to engage with or disengage from the ratchet disk.

3. The cocking device as claimed in claim 2, wherein the cocking unit includes a pin and a resilient member, the resilient member has a first end mounted to the pin, a second end of the resilient member connected to the second end of the stop, when the lever is operated to pivot the stop to be disengaged from the ratchet disk, the stop pulls the resilient member to store a recovery force, when lever of the stop is released, the recovery force of the resilient member pivots the stop to engage with the ratchet disk.

4. The cocking device as claimed in claim 1, wherein the cocking unit includes a pin and a resilient member, the resilient member has a first end mounted to the pin, a second end of the resilient member connected to the second end of the stop, when the lever is operated to pivot the stop to be disengaged from the ratchet disk, the stop pulls the resilient member to store a recovery force, when lever of the stop is released, the recovery force of the resilient member pivots the stop to engage with the ratchet disk.

5. The cocking device as claimed in claim 1, wherein a column is adapted to be located in the grip, the second end of the scrolling member is connected to the column, the cocking unit is pivoted to pull the scrolling member.

6. The cocking device as claimed in claim 5, wherein the locking unit includes a hooking member and a spring, the hooking member has a first end thereof pivotably connected to the cocking unit, a hook end is formed on a second end of the hooking member, the spring has a first end thereof biasing the cocking unit, a second end of the spring is mounted to a protrusion of the hooking member, the hooking end hooks to a rod adapted to be located in the grip when the hooking member is pivoted to be adapted to be engaged with the grip.

* * * * *